US007045218B2

(12) United States Patent
Layton

(10) Patent No.: US 7,045,218 B2
(45) **Date of Patent: *May 16, 2006**

(54) AWARD APPARATUS AND METHOD OF MAKING AN AWARD

(75) Inventor: Mark L. Layton, Orem, UT (US)

(73) Assignee: Mark L. Layton Productions, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/454,277

(22) Filed: Jun. 3, 2003

(65) Prior Publication Data

US 2005/0266259 A1 Dec. 1, 2005

(51) Int. Cl.
*G09F 19/00* (2006.01)

(52) U.S. Cl. ..... 428/542.4; 428/7; D11/162

(58) Field of Classification Search ..... 428/11, 428/542.4, 7; 40/409
See application file for complete search history.

(56) References Cited

U.S. PATENT DOCUMENTS 3,595,727 A * 7/1971 Allen ..... 248/176.1
D285,183 S 8/1986 Lester, Jr.
D293,221 S 12/1987 Pierce
4,946,745 A 8/1990 Kempa
D312,058 S 11/1990 Vermillion
D321,842 S 11/1991 Nys
5,322,739 A * 6/1994 Stagl ..... 428/542.4
5,424,137 A * 6/1995 Stagl ..... 428/542.4
5,853,823 A * 12/1998 McKenna ..... 428/7
6,328,171 B1 12/2001 Coppel

* cited by examiner

*Primary Examiner*—Cathy F. Lam
(74) *Attorney, Agent, or Firm*—Kulani Fisher; Rader, Fishman & Grauer PLLC

(57) ABSTRACT

An award apparatus includes a second member coupled to a first member, wherein the second member is another award that is configured to be worn separately. A portion of the second member may include a display depicting at least the first member. A method for making an award includes providing a first member and connecting a second member to the first member, wherein the second member is another award that is configured to be worn separately. The method may also include displaying on the second member a depiction of at least a portion the first member.

15 Claims, 7 Drawing Sheets

AWARD APPARATUS AND METHOD OF MAKING AN AWARD

FIELD

This application relates to awards and methods of making awards. More particularly, this application concerns novel structures for statues, trophies and medals used as awards.

BACKGROUND

It is commonly known to provide trophies including statues to participants in various types of contests and competition. Such statues may be mounted on a base having an engraved message with information about the contest and the type of award being given.

Statues used for trophies often depict a figure of one or more persons. In some instances, the figures depict likenesses of participants in a contest. Examples are shown in U.S. Design Pat. No. 293,221 and U.S. Pat. No. 5,322,739, in which football players and a golfer are depicted in action. Other such trophies may depict an object that is a part of the contest, such as in U.S. Design Pat. No. 321,842 showing a sailboat and U.S. Pat. No. 5,853,823 depicting a soccer ball.

Statues sometimes show inspiring, fictional or romantic figures that are meant to inspire, educate or stimulate imagination, rather than to depict a specific person or individual. An example is given in U.S. Design Pat. No. 312,058 showing an angel figurine. Often, a statute will depict a person in a heroic stance or depict a situation that is exaggerated in a heroic manner, again to inspire or depict excellence in some achievement.

Medallions are also commonly awarded to participants in various types of contests. Such medallions may be provided with a chain, ribbon or other means for attaching the medallion around the neck or on the lapel of the recipient. In some instances, such medallions show various figures or objects related to the contest in point. An example is shown in U.S. Design Pat. No. 285,183, showing a medallion with various sports objects thereon.

SUMMARY

The present application discloses a statue that may be awarded as a trophy for winning or showing excellence in competition. In addition, the statue of the present application includes a medallion supported by the statue that is indicative of a medallion that may be awarded in connection with competition. Further, the medallion may include a depiction of the statue supporting the medallion.

In one instance disclosed herein, the award comprises a first member, and a second member coupled to the first member, wherein the second member represents another award that may be worn separately.

In another embodiment, an award is provided that comprises a first member and a second member coupled to the first member, wherein a portion of the second member includes a display depicting at least the first member.

A method is also provided for making an award, comprising providing a first member, and connecting a second member to the first member, wherein the second member represents another award that may be worn separately.

In another instance, a method is provided for making an award comprising providing a first member, providing a second member connected to the first member, and displaying on the second member a depiction of at least a portion the first member.

Other aspects and advantages of the present invention will become apparent from the following detailed description, which in conjunction with the accompanying drawings illustrates by way of example the principles of the present invention.

DETAILED DESCRIPTION

Figure 1A:
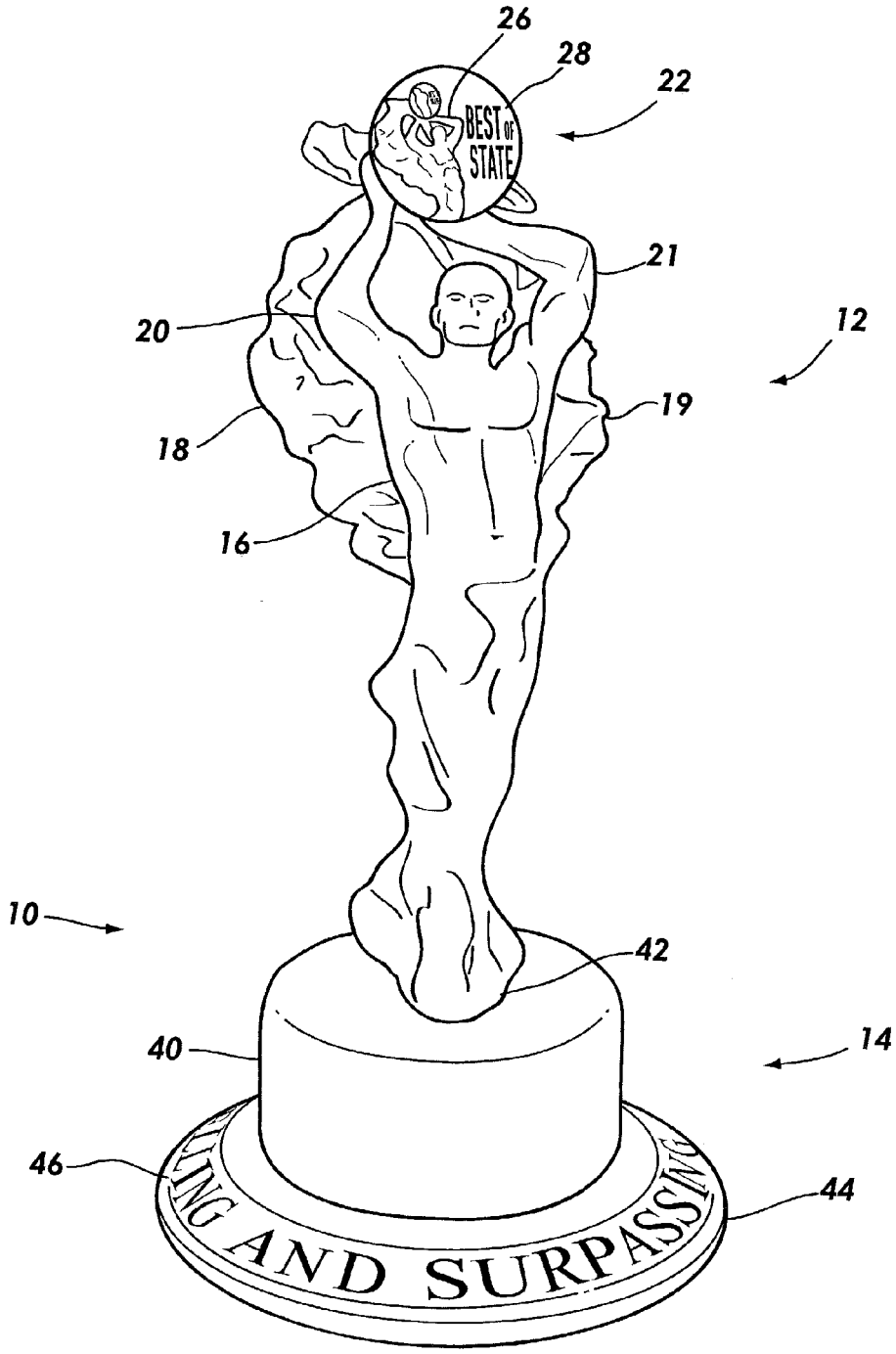
FIG. 1A is a front view of one implementation of the award.

Referring now to FIG. 1A, one implementation of a trophy or award 10 is given, showing a statue 12 mounted on a base 14. The statue depicts a heroic male FIG. 16 having wings 18 and 19 extending behind the FIG. 16. Statue FIG. 16 has his arms 20 and 21 uplifted to support a round coin-shaped medallion portion 22 above his head. Medallion portion 22 is supported so as to display the surface of the medallion 22, having a depiction 26 of the statue FIG. 16 with the medallion 20 shown on the medallion surface. The medallion may also depict words or slogans 28 representative of the competition involved with the trophy or award 10.

Figure 1B:
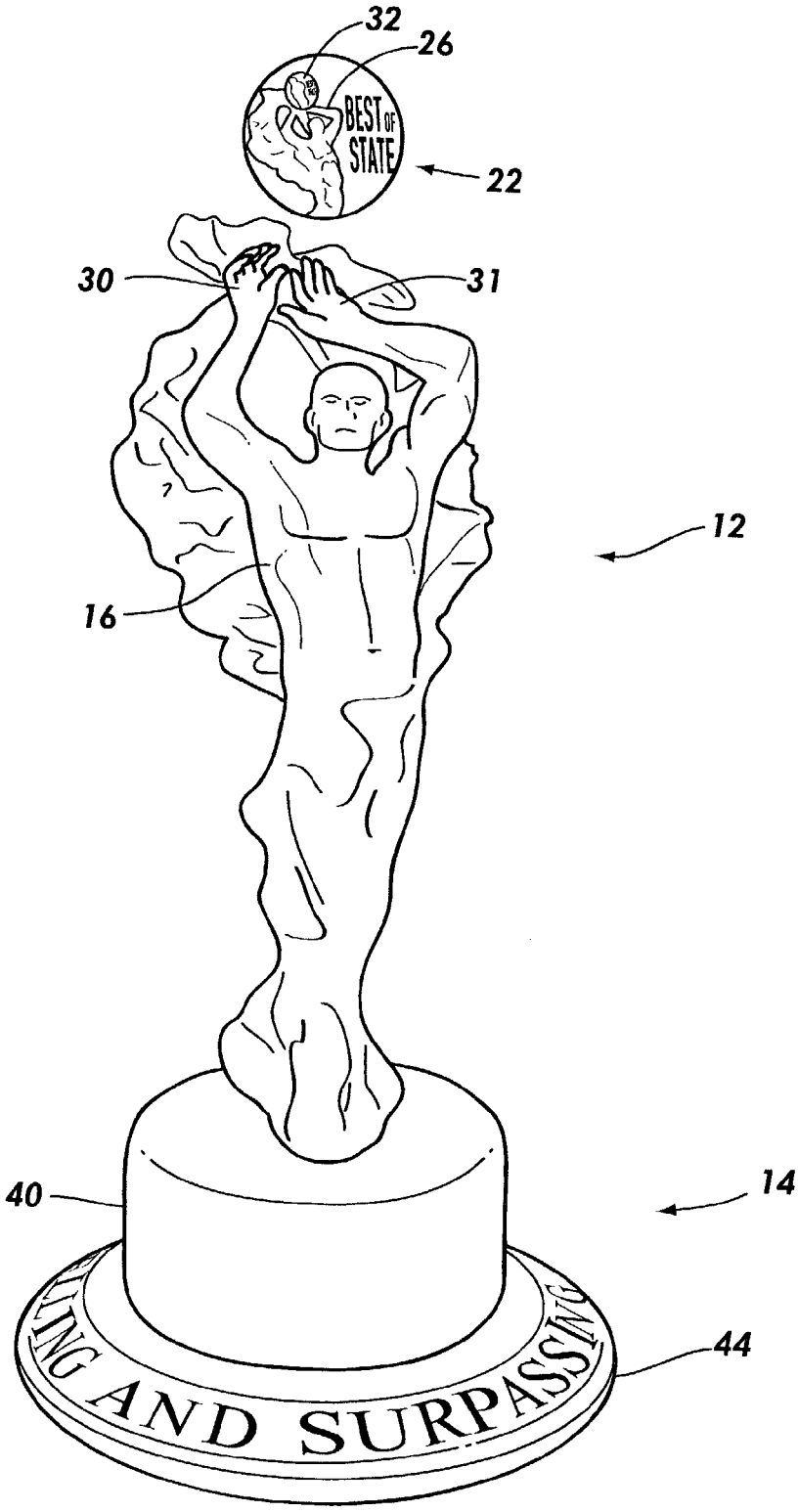
FIG. 1B is a front exploded view of FIG. 1A.

The medallion 22 may further represent a separate medallion that can be awarded to participants in the relevant competition or contest. For clarity, FIG. 1B shows an exploded view of FIG. 1A, in which the medallion portion 22 has been separated from the hands 30 and 31 of the statue FIG. 16. If desired, the medallion portion 22 may be worn separately from the FIG. 16. Further, the medallion portion 22 may iteratively include a depiction of at least a portion of the combination of the statue FIG. 16 and the medallion portion 22. Although not clearly shown in FIG. 1B, the statue depiction 26 may further include second depiction 32, again showing a statue figure with medallion, thus depicting another iteration. Successive iterations may be depicted as desired. In addition, a separate medallion or medallions (not shown) similar to the medallion coupled to the statue may be awarded separately.

As seen in FIGS. 1–6, the statue 12 includes a base 14, having a pedestal 40 coupled to the base bottom 42 of FIG. 16. A broad circular support footing 44 is connected to the bottom of pedestal 40. Selected wording 46 is inscribed or embossed on the surface of the footing 44.

Figure 2:
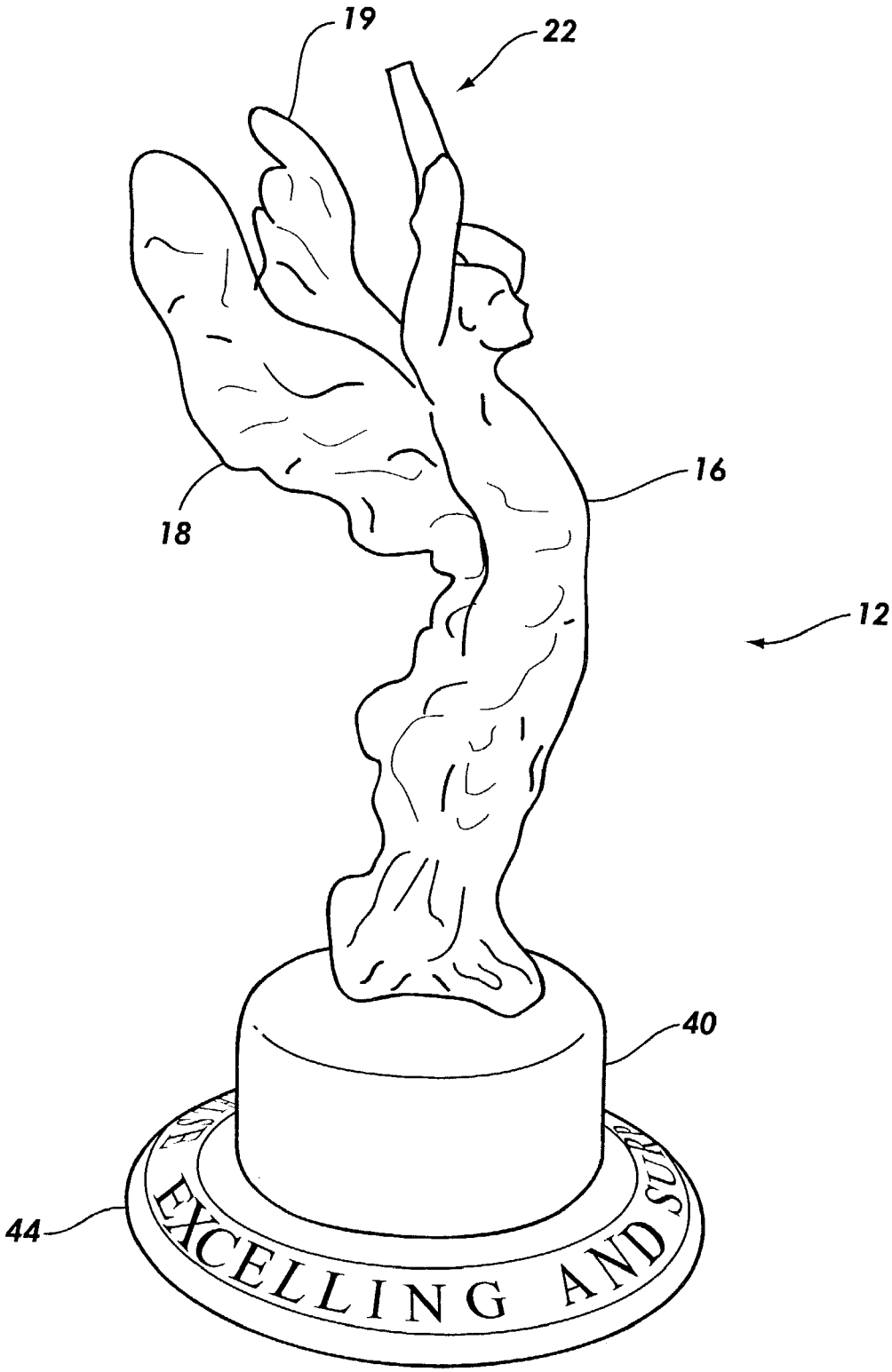
FIG. 2 is a side view of the award of FIG. 1.
Figure 3:
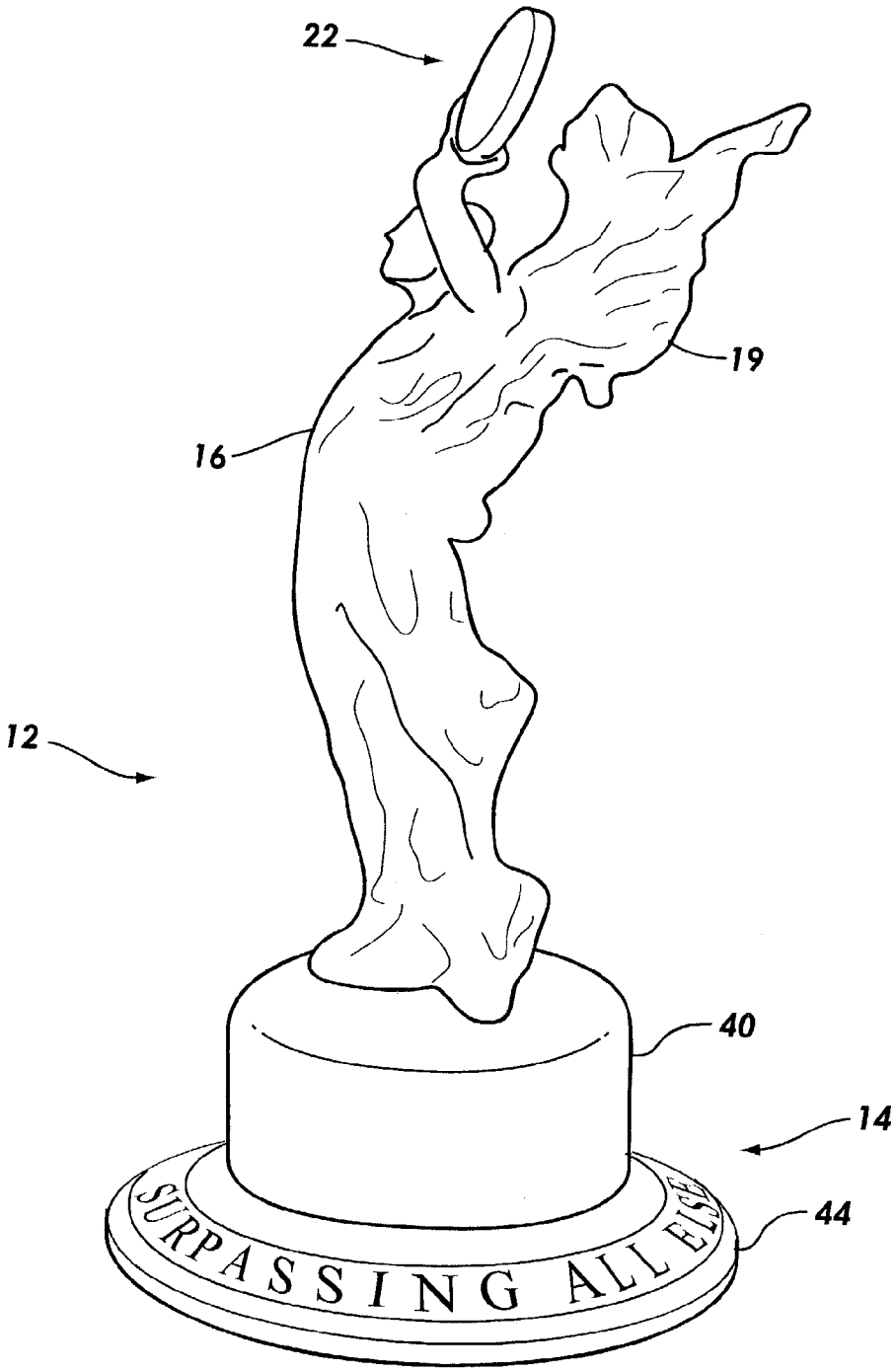
FIG. 3 is a side view of the award of FIG. 1 as seen from the opposing side of the view depicted in FIG. 2.
Figure 4:
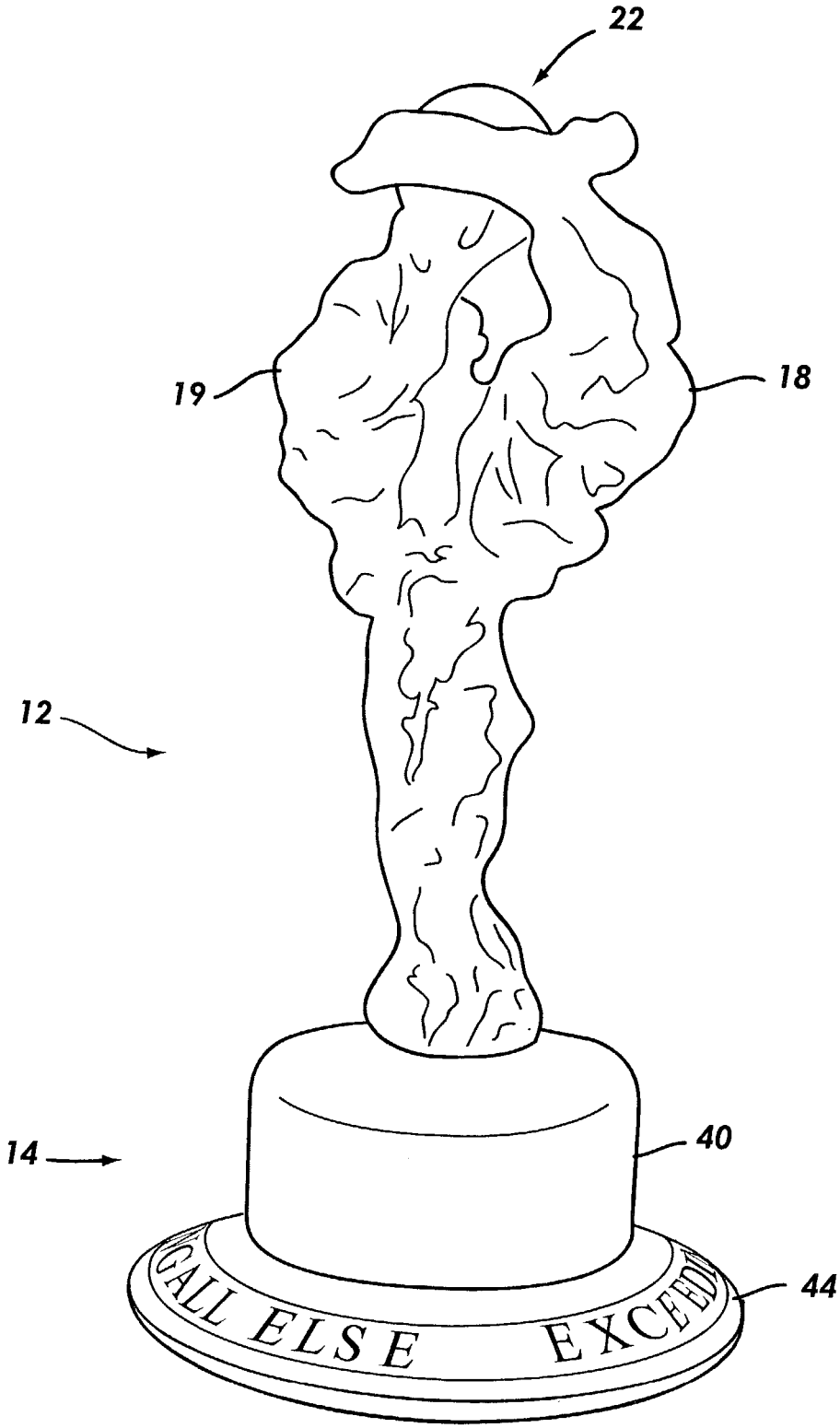
FIG. 4 is a rear view of the award of FIG. 1.
Figure 5:
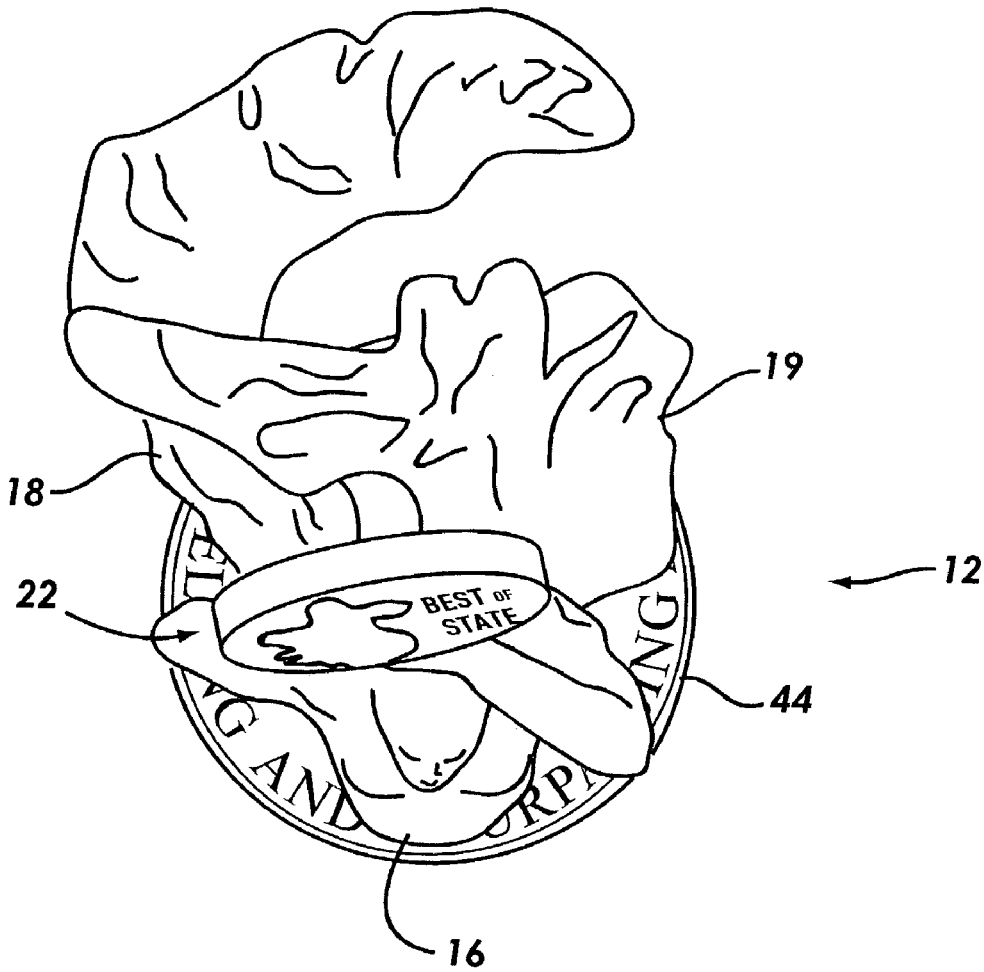
FIG. 5 is an overhead view of the award of FIG. 1.
Figure 6:
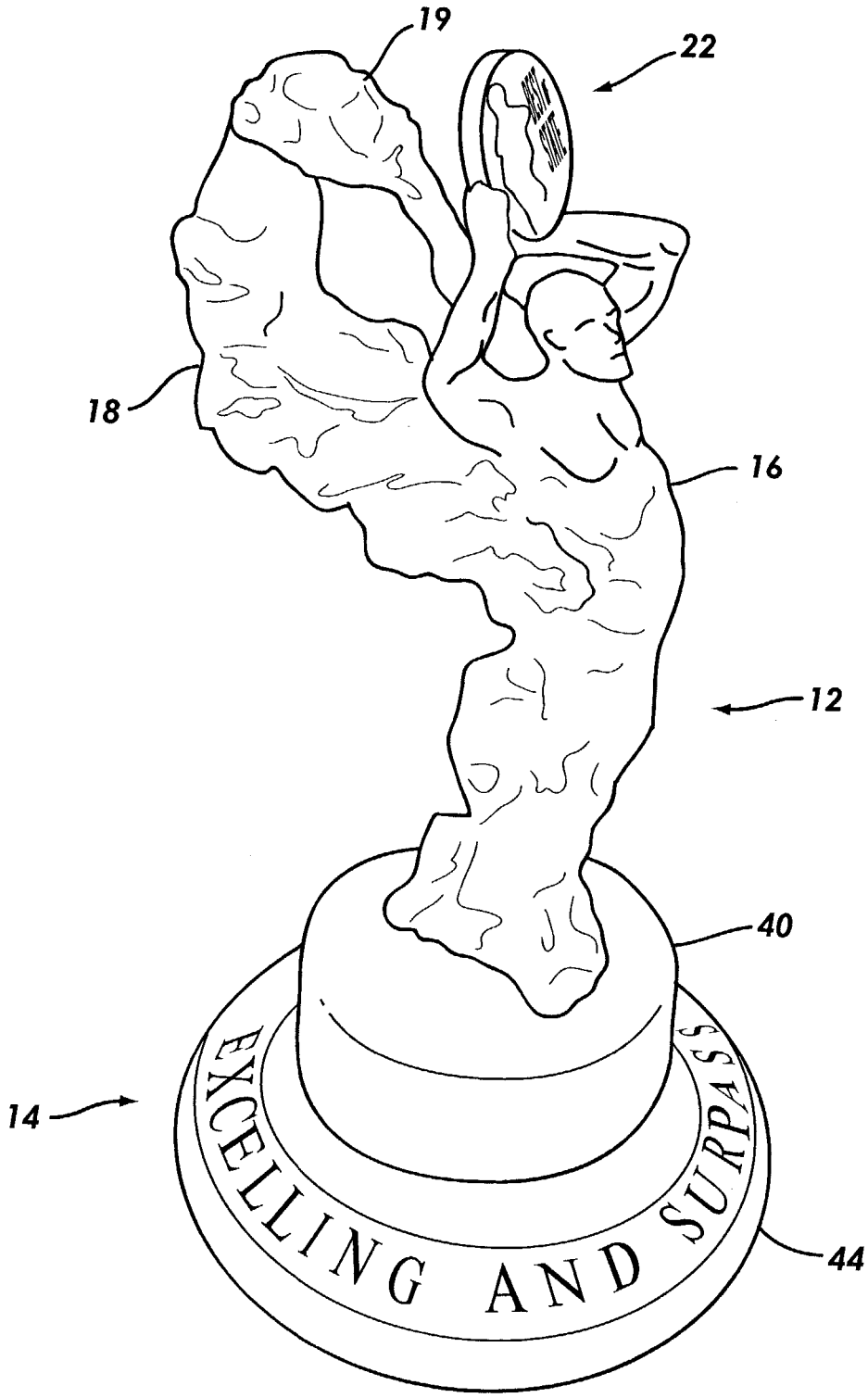
FIG. 6 is a perspective view of the award of FIG. 1.

As shown in the figures, statute 12 is three-dimensional object, so that wings 18 and 19 extend behind FIG. 16. Medallion portion 22 may also be angled relative to FIG. 16, as best seen in FIGS. 2 and 3.

Although the above embodiments are representative of the present invention, other embodiments will be apparent to those skilled in the art from a consideration of this specification and the appended claims, or from a practice of the embodiments of the disclosed invention. It is intended that the specification and embodiments therein be considered as exemplary only, with the present invention being defined by the claims and their equivalents.

I claim:

1. An award, comprising:

a first member, and a second member directly coupled to the first member, wherein the second member represents another award configured to be worn separately, said first member being a statue and said second member being a medallion.

2. The award of claim 1, wherein the second member is configured to be worn separately.

3. The award of claim 1, wherein the second member is removably coupled to the first member.

4. The award of claim 1, wherein the second member is fixedly coupled to the first member.

5. An award, comprising:

a first member, and a second member coupled to the first member, wherein a portion of the second member includes a display depicting at least the first member, said first member being a statue and said second member being medallion.

6. The award of claim 5, wherein the display depicts the first member coupled to the second member.

7. The award of claim 6, wherein the display depicts the second member further displaying the first member coupled to the second member.

8. The award of claim 5, wherein the second member is configured to be worn separately.

9. The award of claim 5, wherein the second member is removably coupled to the first member.

10. The award of claim 5, wherein the second member is fixedly coupled to the first member.

11. A method of making an award, comprising:

providing a first member, and directly connecting a second member to the first member, wherein the second member is represents another award configured to be worn separately, said first member being a statue and said second member being a medallion.

12. The method of claim 11, farther comprising removably coupling the second member to the first member.

13. A method of making an ward, comprising:

providing a first member, providing a second member connected to the first member, and displaying on the second member a depiction of at least a portion the first member, said first member being a statue and said second member being a medallion.

14. The method of claim 13, further comprising displaying on the second member a depiction of the first member coupled to the second member.

15. The method of claim 14, further comprising displaying on the depiction of the second member a further depiction of the first member coupled to the second member.

* * * * *

UNITED STATES PATENT AND TRADEMARK OFFICE

CERTIFICATE OF CORRECTION

PATENT NO. : 7,045,218 B2
APPLICATION NO. : 10/454277
DATED : May 16, 2006
INVENTOR(S) : Mark L. Layton It is certified that error appears in the above-identified patent and that said Letters Patent is hereby corrected as shown below:

Use the following format to correct typographical errors:

Column 3, Line 4, Claim 1, change "a second member directly coupled to the first mamber" to -- a second member coupled to the first member --

Column 4, Line 7, Claim 11, change "directly connecting a second member to the first member" to -- connecting a second member to the first member --

Column 4, Line 8, Claim 11, change "wherein the second member is represents another" to -- wherein the second member represents another --

Signed and Sealed this

Fifth Day of September, 2006

JON W. DUDAS
*Director of the United States Patent and Trademark Office*